US009199424B2

(12) United States Patent
Basconnet

(10) Patent No.: US 9,199,424 B2
(45) Date of Patent: Dec. 1, 2015

(54) METHOD FOR PRODUCING A LARGE-CAPACITY, PLIABLE CONTAINER AND INNER PROTECTIVE ENVELOPE PRODUCED DURING SAID METHOD

(75) Inventor: Jacques Basconnet, Chateauvillain (FR)

(73) Assignee: TISZA TEXTIL PACKAGING, Chaumont (FR)

( * ) Notice: Subject to any disclaimer, the term of this patent is extended or adjusted under 35 U.S.C. 154(b) by 651 days.

(21) Appl. No.: 13/578,704

(22) PCT Filed: Feb. 24, 2011

(86) PCT No.: PCT/FR2011/050389

§ 371 (c)(1),
(2), (4) Date: Aug. 13, 2012

(87) PCT Pub. No.: WO2011/104485

PCT Pub. Date: Sep. 1, 2011

(65) Prior Publication Data

US 2012/0312865 A1 Dec. 13, 2012

(30) Foreign Application Priority Data

Feb. 26, 2010 (FR) ..... 10 51406

(51) Int. Cl.

| | |
|---|---|
| ***B31B 1/64*** | (2006.01) |
| ***B65D 27/08*** | (2006.01) |
| ***B31B 37/00*** | (2006.01) |
| ***B65D 90/04*** | (2006.01) |
| ***B65D 90/20*** | (2006.01) |

(52) U.S. Cl.

CPC ..... *B31B 37/00* (2013.01); *B65D 90/046* (2013.01); *B65D 90/205* (2013.01); *B31B 2237/05* (2013.01); *B65D 2590/046* (2013.01)

(58) Field of Classification Search

CPC .. B31B 37/00; B31B 2237/05; B65D 90/046; B65D 90/205; B65D 2590/046

USPC ..... 493/210, 215, 217, 294, 297, 386, 379; 53/175; 229/72

See application file for complete search history.

(56) References Cited

U.S. PATENT DOCUMENTS

| | | | | |
|---|---|---|---|---|
| 4,781,472 | A * | 11/1988 | LaFleur et al. | 383/16 |
| 4,874,258 | A * | 10/1989 | Marino | 383/111 |
| 5,618,254 | A * | 4/1997 | Derby | 493/197 |
| 6,139,482 | A * | 10/2000 | Lafleur | 493/217 |
| 2004/0120612 | A1 * | 6/2004 | La Fleur et al. | 383/111 |

FOREIGN PATENT DOCUMENTS

BE 1 001 225 A6 8/1989

OTHER PUBLICATIONS

International Search Report, dated Jul. 4, 2011, from corresponding PCT application.

* cited by examiner

*Primary Examiner* — Stephen F Gerrity
*Assistant Examiner* — Dianne Mitchell
(74) *Attorney, Agent, or Firm* — Young & Thompson

(57) ABSTRACT

A method for producing a large-capacity, pliable container, includes the steps of a) producing a tubular bellows-type sleeve, b) cutting lateral folding regions of the folded bellows-type sleeve, d) soldering adjacent cutting edges in such a way as to produce a parallelepipedic inner protective envelope having a square cross-section (1*b*), e) sticking fixing lugs (13) to two opposite lateral fixing faces (14*a*, 14*b*) of the folded bellows-type sleeve, (f) applying a tractive force to the fixing lugs (13) in order to deform, by stretching, the parallelepipedic inner protective envelope having a square cross-section and to obtain a parallelepipedic inner protective envelope having a rectangular cross-section (1), step g) soldering the outer lateral pockets (17*a*, 17*b*), and a step B) of assembling the inner protective envelope having a rectangular cross-section (1) with the outer envelope in order to form the large-capacity pliable container.

9 Claims, 6 Drawing Sheets f)

B)

METHOD FOR PRODUCING A LARGE-CAPACITY, PLIABLE CONTAINER AND INNER PROTECTIVE ENVELOPE PRODUCED DURING SAID METHOD

The present invention relates to a method for producing a large-capacity pliable container, and an inner protective envelope produced during said process.

BACKGROUND OF THE INVENTION

Large-capacity pliable containers are used e.g. in the pharmaceutical industry or in the chemical industry.

They are intended to contain semi-finished products and finished products in solid form as powders, granules, tablets, or capsules, for example.

They are made of plastic material and have capacities from 100 to 600 liters.

They contain an inner protective envelope to be inserted into an outer envelope.

The packaging, consisting of one inner and one outer envelope, is disposable after use, which ensures that it is perfectly clean as it is used only once. This feature avoids risks of contamination unlike reusable rigid containers that need to be washed, aseptized, identified. The unit cost of use is much lower in the end and the risk of mixture of one batch with another is avoided.

The known outer envelopes consist of a woven polymeric material such as e.g. polypropylene, which is a strong material ensuring that the outer envelope is able to hold a load weighing from several dozen kilograms up to and even more than 500 kg.

The individual elements of the outer envelope are produced by cutting and are sewn together.

The inner protective envelope, commonly referred to as a bag or liner, must be perfectly tight. It is intended to protect the contents of the pliable container from its environment (moisture, smell, light, gas).

The inner protective envelope is made from a polymeric material, e.g. such as polyethylene. It can also be made from nobler materials, such as complex laminates based on aluminium, polyamide or technical plastics imparting more specific properties.

The materials used and the methods for producing inner protective envelopes must meet the highest standards of the pharmaceutical industry, in particular the requirements in terms of cleanliness, non-pollution and sterility.

The inner protective envelope is assembled with the outer envelope for producing the large-capacity pliable container.

Large-capacity pliable containers 2*b* of the prior art, as illustrated in FIG. 1, have a parallelepipedic shape with a square cross-section.

Pliable containers 2*b* are intended to be inserted into a metal frame 2*a* and supported thereby.

Due to their parallelepipedic shape of square cross-section pliable containers can only be used for metal frames having a square cross-section.

However, most storage racks used e.g. in the pharmaceutical industry are configured to accommodate containers of rectangular cross-section.

Inserting a pliable container of square cross-section into a metal frame of rectangular cross-section entails a loss in storage space.

Therefore, there is a need for pliable containers having a rectangular cross-section in order to increase the storage capacities and be able to use them within metal frames of rectangular cross-section, which are widely used in the industry.

Nevertheless, such pliable containers having a rectangular cross-section are not easily produced.

Actually, it is not possible to produce an inner protective envelope of rectangular cross-section using the manufacturing methods of the prior art.

Such inner protective envelopes of rectangular cross-section cannot be produced through the sole folding, cutting and soldering operations commonly used in this sector.

In particular, such operations are not likely to produce inner protective envelopes of rectangular cross-section having spouts of square cross-section.

Only square cross-sections can be obtained using the conventional folding methods.

SUMMARY OF INVENTION

It is, therefore, an object of the present invention to propose a method for producing a large-capacity pliable container having a rectangular cross section, which in addition prevents pollution inside the inner protective envelope during the manufacturing process.

To this effect, the invention relates to a method for producing a large-capacity pliable container comprising an inner protective envelope of plastic material to be inserted into an outer envelope, said method comprising the following steps:

A) manufacturing the inner protective envelope by:

a) producing a tubular bellows-type sleeve using an extrusion-blow molding process including a process of forming folds on the tubular bellows-type sleeve, said tubular bellows-type sleeve having a folded shape after the step a), b) cutting a portion of the tubular bellows-type sleeve to produce a folded bellows-type sleeve having a rectangular shape, said folded bellows-type sleeve consisting of two opposite open ends and two lateral folding regions, separated by a central longitudinal axis, each lateral folding region comprising three folding lines : one inner folding line which extends along and close to the central longitudinal axis, and two outer folding lines, c) cutting lateral folding regions in the four corners of the folded bellows-type sleeve in such a way as to obtain a folded bellows-type sleeve having two narrowed portions at its open ends, each of said narrowed portions being delimited by two lateral cut borders, each comprising four cutting edges stacked together, d) soldering adjacent cutting edges for each of said lateral cut edges in such a way as to produce, when the folded bellows-type sleeve is unfolded, a parallelepipedic inner protective envelope having a square cross-section, which comprises a spout of square cross-section at its top and bottom ends, and e) sticking fixing lugs to two opposite lateral fixing faces of the folded bellows-type sleeve, each of said lateral fixing faces comprising a least four fixing lugs.

According to the invention, the method comprises the following steps :

f) applying a tractive force to the fixing lugs in order to deform by stretching the parallelepipedic inner protective envelope having a square cross-section and to obtain a parallelepipedic inner protective envelope having a rectangular cross-section, said inner protective envelope of rectangular cross-section comprising four lateral faces, of which said two lateral fixing faces and two opposite stretched lateral faces of rectangular shape, each comprising an upper edge, a lower edge and two outer lateral pockets extending along said upper and lower edges, respectively, g) soldering the outer lateral pockets to isolate them from the rest of the inner protective envelope of rectangular cross-section, h) cutting the outer lateral pockets to remove them from the two stretched lateral faces, B) assembling the inner protective envelope having a rectangular cross-section with the outer envelope in order to form said large-capacity pliable container.

In various possible embodiments, the present invention also relates to the following features, which may be considered separately or with regard to their technically feasible combinations of features, each offering specific advantages :

- during the step e) of sticking the fixing lugs, four fixing lugs are stuck to each of the lateral fixing faces of the folded bellows-type sleeve, said fixing lugs being adjacent to all four corners of the lateral fixing lugs,
- fixing lugs are adhesive T-shaped fixing lugs,
- the step c) of cutting the lateral folding regions comprises, for each lateral folding region, two cutting operations in order to obtain two symmetrical cuts relative to the central longitudinal axis, each cutting operation being carried out along a first cutting line extending obliquely relative to the central longitudinal axis and along a second cutting line parallel to the central longitudinal axis,
- the cutting steps b), c) and h) are carried out ultrasonically or by means of a hot blade,
- the soldering steps d) et g) are carried out by heat sealing,
- the step g) of soldering the outer lateral pockets takes place outside the inner protective envelope,
- as the outer envelope is made of several panels of polymeric material, of which one upper panel, two small-sized lateral panels and two large-sized lateral panels, during the assembling step B), the outer envelope is produced by sewing said panels around the inner protective envelope of rectangular cross-section in such a way as to insert the latter into the outer envelope, the fixing lugs of the inner protective envelope of rectangular cross-section being incorporated into the seams formed between said panels,
- the fixing lugs are positioned on the lateral edges of the inner protective envelope of rectangular cross-section, said fixing lugs extending through the outer envelope at the lateral edges thereof.

The invention also relates to an inner protective envelope produced during the process for producing an inner protective envelope, as defined previously. The inner protective envelope has a parallelepiped shape of rectangular cross-section and comprises a spout having a substantially square cross-section on its upper and lower faces.

Therefore, the invention provides a method for producing a large-capacity pliable container having a rectangular parallelepiped shape without polluting the inside of the inner protective envelope.

The rectangular shape of the inner protective envelope is obtained without any operation inside said envelope.

Inner protective envelopes having a rectangular cross-section address a need in the industry: most commonly used metal frames and storage racks have a rectangular cross-section.

BRIEF DESCRIPTION OF THE DRAWINGS

The invention will now be described in more details with reference to the accompanying drawings, in which.

DETAILED DESCRIPTION OF THE PREFERRED EMBODIMENTS

The method for manufacturing a large-capacity pliable container 2 comprises a step a) for producing a tubular bellows-type sleeve using an extrusion-blow molding process including a process of forming folds. After step a) the tubular bellows-type sleeve is shaped as a folded bellows-type sleeve.

Figure 1:
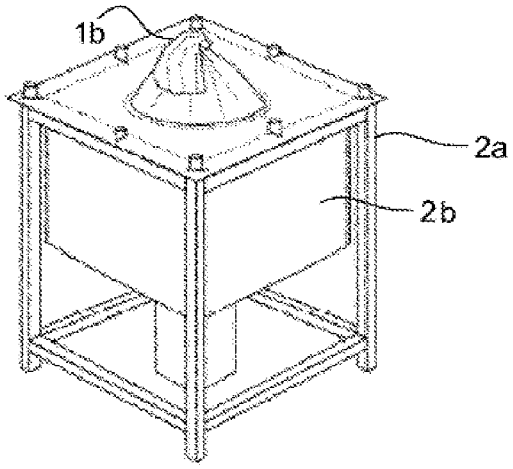
FIGURE 1 PRIOR ART
FIG. 1 shows a pliable container of square cross-section of the prior art, mounted within a metal frame.
Figure 2:
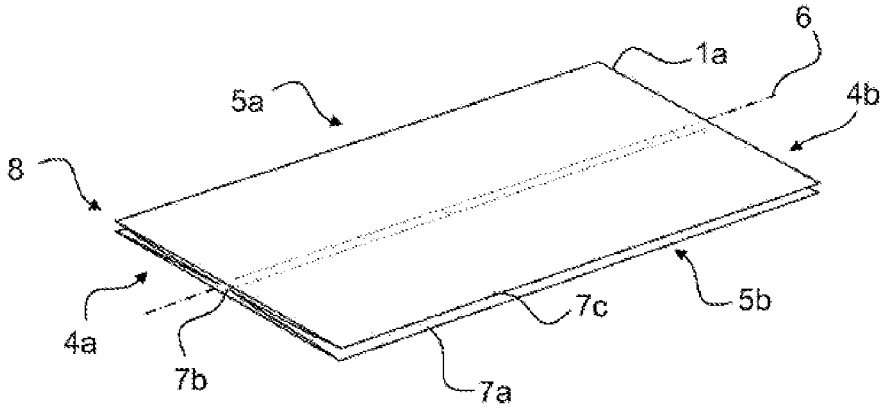
FIG. 2 shows a folded bellows-type sleeve according to one embodiment of the invention.

The method for producing a large-capacity pliable container 2 comprises a step b) of cutting a portion of the tubular bellows-type sleeve in such a way as to obtain a folded bellows-type sleeve la, as illustrated in FIG. 2.

Such folded bellows-type sleeve 1*a* is made of polymeric material, preferably polyethylene.

It can also be made from nobler materials such as complex laminates based on aluminium, polyamide or technical plastics imparting more specific properties.

The folded bellows-type sleeve la has a rectangular shape. It comprises two opposite open ends 4*a*4*b* and two lateral folding regions 5*a*, 5*b*, separated by a central longitudinal axis 6.

Each lateral folding region 5*a*, 5*b* comprises three folding lines 7*a*, 7*b*, 7*c*, of which one inner folding line 7*b* extending along and close to the central longitudinal axis 6, and two outer folding lines 7*a*, 7*c*.

In other words, each lateral folding region 5*a*, 5*b* forms a bellows having three folds, of which one central fold.

The inner folding lines 7*b* of the two lateral folding regions 5*a*, 5*b* are adjacent. The two lateral folding regions 5*a*, 5*b* are disposed symmetrically with respect to the central longitudinal axis 6.

Figure 3:
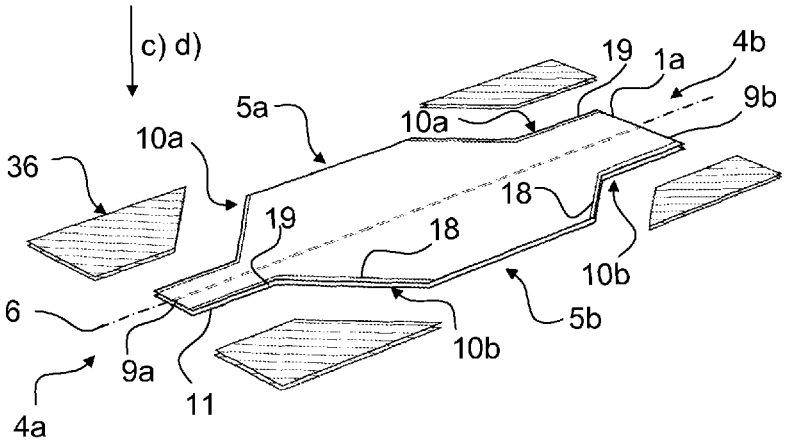
FIG. 3 shows a folded bellows-type sleeve with two narrowed end parts, produced after a cutting step c) and a step d) of soldering the cutting edges according to an embodiment of the invention.

The method for producing a large-capacity pliable container 2 comprises a step c) of cutting the lateral folding regions 5*a*, 5*b* at the corners 8 of the folded bellows-type sleeve 1*a*, thus providing a folded bellows-type sleeve la having two narrowed portions 9*a*, 9*b* at its open ends 4*a*, 4*b*, as illustrated in FIG. 3.

Each of the narrowed portions 9*a*, 9*b* is delimited by two lateral cut borders 10*a*, 10*b*, each comprising four cutting edges 11 stacked together.

The number of cutting edges 11 depends on the number of folds or folding lines. In fact, three folding lines correspond to four layers stacked on top of each other to form a bellows. Cutting four stacked layers produces four cutting edges 11.

As each lateral folding region 5*a*, 5*b* or each bellows has two outer folding lines 7*a*, 7*c*, two cuts have to be made for each corner 8 of the bellows-type sleeve. In fact, there is a total of eight portions located in the corners of the tubular bellows-type sleeve portion that are cut in such a way as to produce constrictions at the ends.

The step c) of cutting the lateral folding regions comprises, for each lateral folding region 5*a*, 5*b*, two cutting operations for obtaining two cuts disposed symmetrically with respect to the central longitudinal axis 6. Each cutting operation is carried out along a first cutting line 18 obliquely relative to the central longitudinal axis 6 and along a second cutting line 19 parallel to the central longitudinal axis 6.

Scrap 36 or unused cut pieces are removed.

The narrowed portions 9*a*, 9*b* are shaped as a flared rectangle. The method for producing a large-capacity pliable container 2 comprises a step d) of soldering the cutting edges 11 adjacent to each other, for each of the lateral cut borders.

Preferably, the cutting and soldering steps are performed simultaneously.

Figure 5:
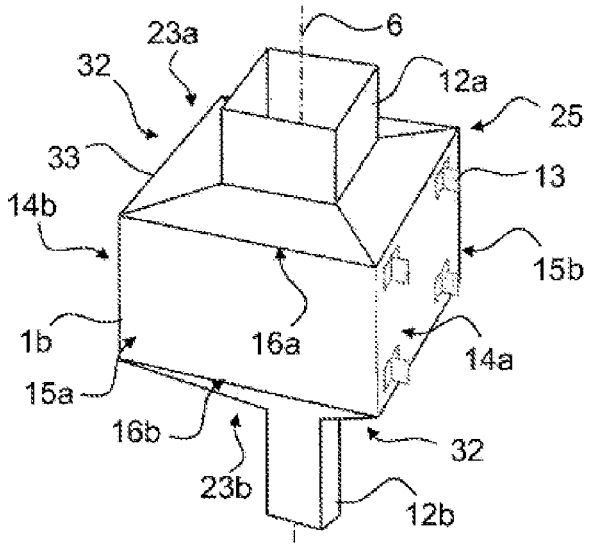
FIG. 5 shows an inner protective envelope having a square cross-section.

When the folded bellows-type sleeve 1*a* is unfolded, a parallelepipedic inner protective envelope of square cross-section 1*b* is obtained, which comprises a spout 12*a*, 12*b* having a square cross-section at its top 23*a* and bottom 23*b* ends, as illustrated in FIG. 5.

The inner protective envelope comprises a filling spout l2*a* at the top end 23*a* of the inner protective envelope, and a discharge spout 12*b* at the bottom end 23*b* of the inner protective envelope.

The inner protective envelope of square cross-section 1*b* is extended at the top and the bottom part by a truncated conical portion 32 of pyramid-shaped cross-section having four faces 33. Each truncated conical portion 32 terminates with one of the spouts 12*a*, 12*b* having a constricted cross-section in order to adapt the product flow to the constraints of the receiving equipment. Each truncated conical portion 32 connects one of the spouts 12*a*, 12*b* to the rest of the inner protective envelope.

The two spouts 12*a*, 12*b* may have the same dimensions, in particular the same height and have faces of identical widths.

Preferably, they have different heights and faces of different widths, as illustrated in FIG. 5.

Alternatively, the spouts 12*a*, 12*b* may have a rectangular cross-section.

In FIG. 5, the spout 12*a* positioned at the top end 23*a* of the inner protective envelope of square cross-section 1*b* is greater in height than the spout 12*b* positioned at the bottom end 23*b* of the inner protective envelope of square cross-section 1*b*. In addition, it has a wider cross-section, i.e. faces of greater width.

Soldering is performed by heat sealing.

As each lateral folding region 5*a*, 5*b* or each bellows has two outer folding lines 7*a*, 7*c* that have been cut, two soldering operations are required for each cut lateral border 10*a*, 10*b* of the bellows-type sleeve.

All cutting edges 11 of the lateral cut borders 10*a*, 10*b* are soldered together so as to form a bellows again.

Each lateral folding region 5*a*, 5*b* still has three folding lines 7*a*, 7*b*, 7*c*, of which one inner folding line 7*b* extending along and close to the central longitudinal axis, and two outer folding lines 7*a*, 7*c*.

The outer folding lines 7*a*, 7*c* each consist of a central portion 24*a* parallel to the central longitudinal axis 6, two oblique portions 24*b* forming an angle with the central longitudinal axis 6, disposed on each side of the central portion 24*a*, and of two lateral portions 24*c* parallel to the central longitudinal axis 6.

The method for producing a large-capacity pliable container 2 comprises a step e) of sticking the fixing lugs 13 to two opposite lateral fixing faces 14*a*, 14*b* of the folded bellows-type sleeve 1*a*. Each of the lateral fixing faces 14*a*, 14*b* comprises at least four fixing lugs 13.

The step e) of sticking the fixing lugs 13 is performed once the tubular bellows-type sleeve is folded.

Figure 4:
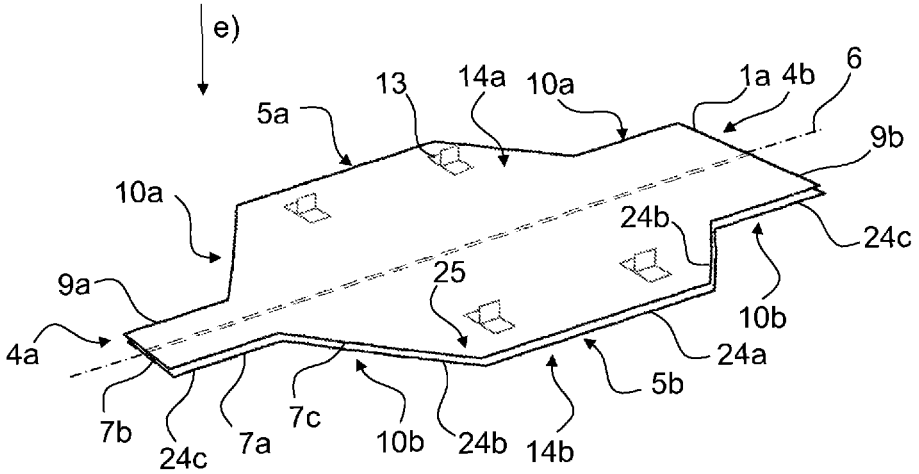
FIG. 4 shows a folded bellows-type sleeve produced after a step e) of sticking the fixing lugs to two opposite lateral fixing faces of the folded bellows-type sleeve according to one embodiment of the invention.

Preferably, four fixing lugs 13 are stuck to each of the lateral fixing faces 14*a*, 14*b* of the folded bellows-type sleeve 1 a, as illustrated in FIGS. 4 and 5.

Fixing lugs 13 are adjacent to the four corners 25 of the lateral fixing faces 14*a*, 14*b*.

Fixing lugs 13 are T-shaped adhesive fixing lugs made of a reinforced pliable material.

Alternatively, the fixing lugs 13 can be stuck to the lateral edges 21 of the inner protective envelope of square cross-section 1*b*. Their number may exceed four.

Figure 6:
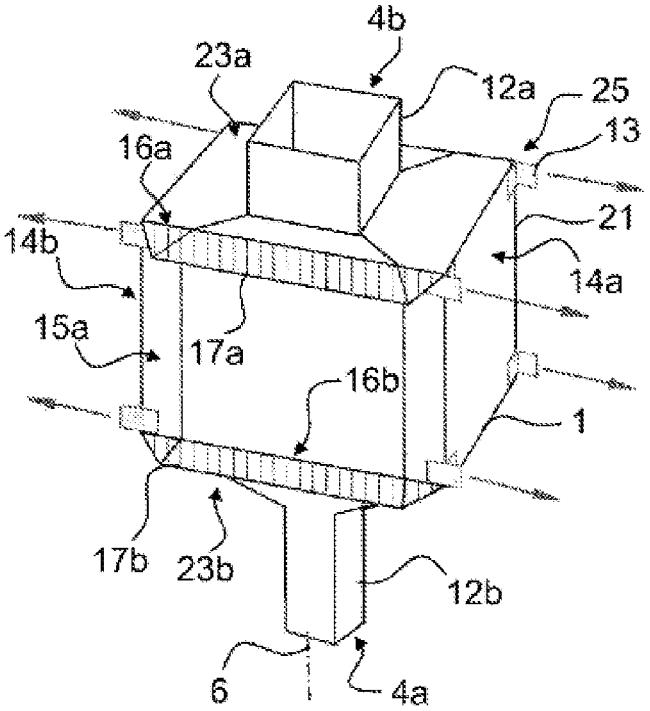
FIG. 6 shows an inner protective envelope having a square cross-section, during a step f) of applying a tractive force on the fixing lugs in order to produce an inner protective envelope of rectangular cross-section according to one embodiment of the invention.

The method for producing a large-capacity pliable container 2 comprises a step f) of applying a tractive force to the fixing lugs in order to deform by stretching the parallelepipedic inner protective envelope of square cross-section 1*b*, and to obtain a parallelepipedic inner protective envelope of rectangular cross-section 1, as illustrated in FIG. 6.

The inner protective envelope of rectangular cross-section 1 comprises four lateral faces, of which the two lateral fixing faces 14*a*, 14*b*, and two opposite stretched lateral faces 15*a*, 15*b* of rectangular shape, each comprising an upper edge 16*a*, a lower edge 16*b*, and two outer lateral pockets 17*a*, 17*b* extending along the upper edge 16*a* and the lower edge 16*b*, respectively.

The two outer lateral pockets 17*a*, 17*b* are produced by stretching the opposite stretched lateral faces 15*a*, 15*b*.

The fixing lugs 13 must sufficiently adhere to the inner protective envelope so that the fixing lugs 13 do not become detached during the step f).

Stretching is made until the desired shape of the inner protective envelope is obtained.

Advantageously, the tractive forces are applied simultaneously to all fixing lugs 13.

The upper and lower faces of the inner protective envelope have also been stretched and have a rectangular shape.

After being deformed, the spouts 12*a*, 12*b* still have a substantially square cross-section. Stretching is done manually or mechanically from outside the inner protective envelope without any risk of pollution inside the inner protective envelope.

The method for producing a large-capacity pliable container 2 comprises a step g) of soldering the outer lateral pockets 17*a*, 17*b* to isolate them from the rest of the inner protective envelope of rectangular cross-section 1, and a step h) of cutting the outer lateral pockets 17*a*, 17*b* to remove them from the two stretched lateral faces 15*a*, 15*b*.

Steps g) and h) are performed outside the inner protective envelope, thus avoiding any risk of pollution inside the inner protective envelope.

Figure 7:
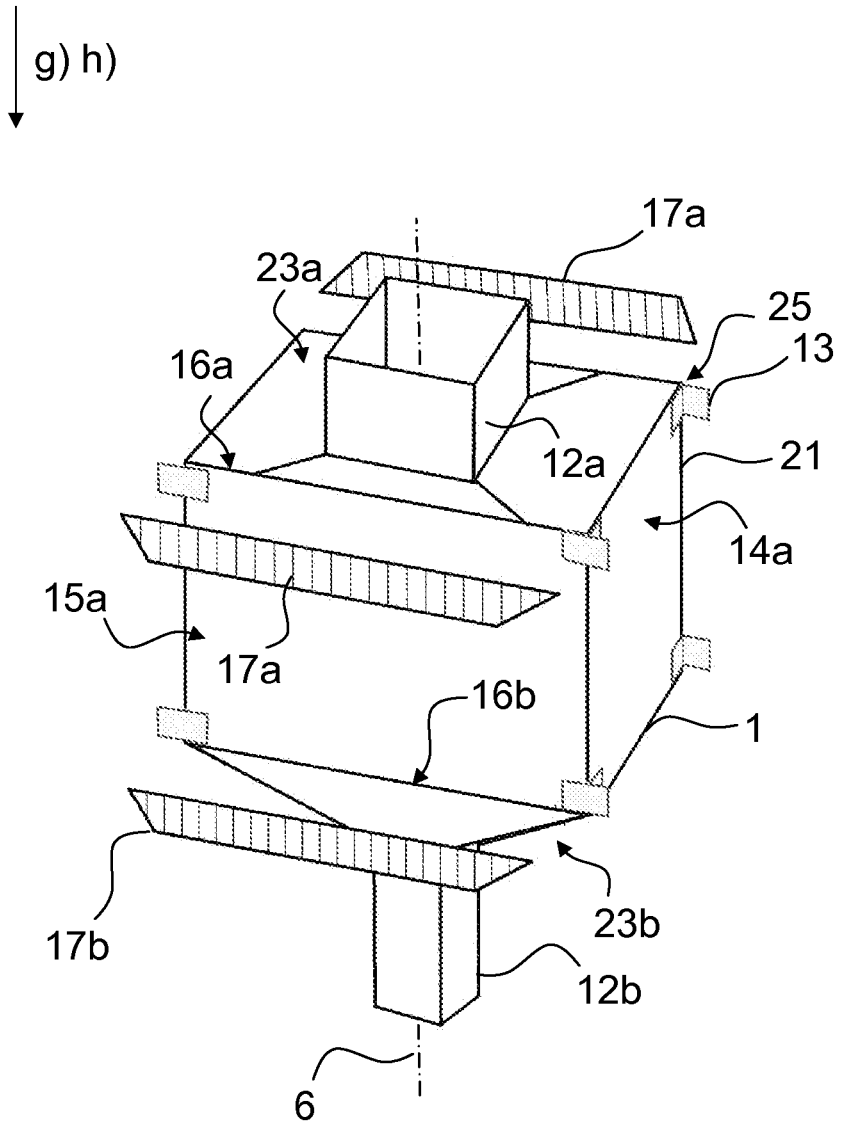
FIG. 7 shows the same inner protective envelope having a rectangular cross-section, obtained after the steps g) of soldering and h) of cutting the outer lateral pockets according to one embodiment of the invention.

An inner protective envelope of rectangular cross-section 1 without outer lateral pockets 17*a*, 17*b* is obtained, as illustrated in FIG. 7.

The soldering steps d) and g) are performed by heat-sealing.

The cutting steps b), c) and h) are performed using an ultrasonic cutting process to prevent fumes being given off and obviate the need for suction hoods. Alternatively, the cutting steps b), c) and h) can be carried out using a hot blade technology (350° C.).

Figure 8:
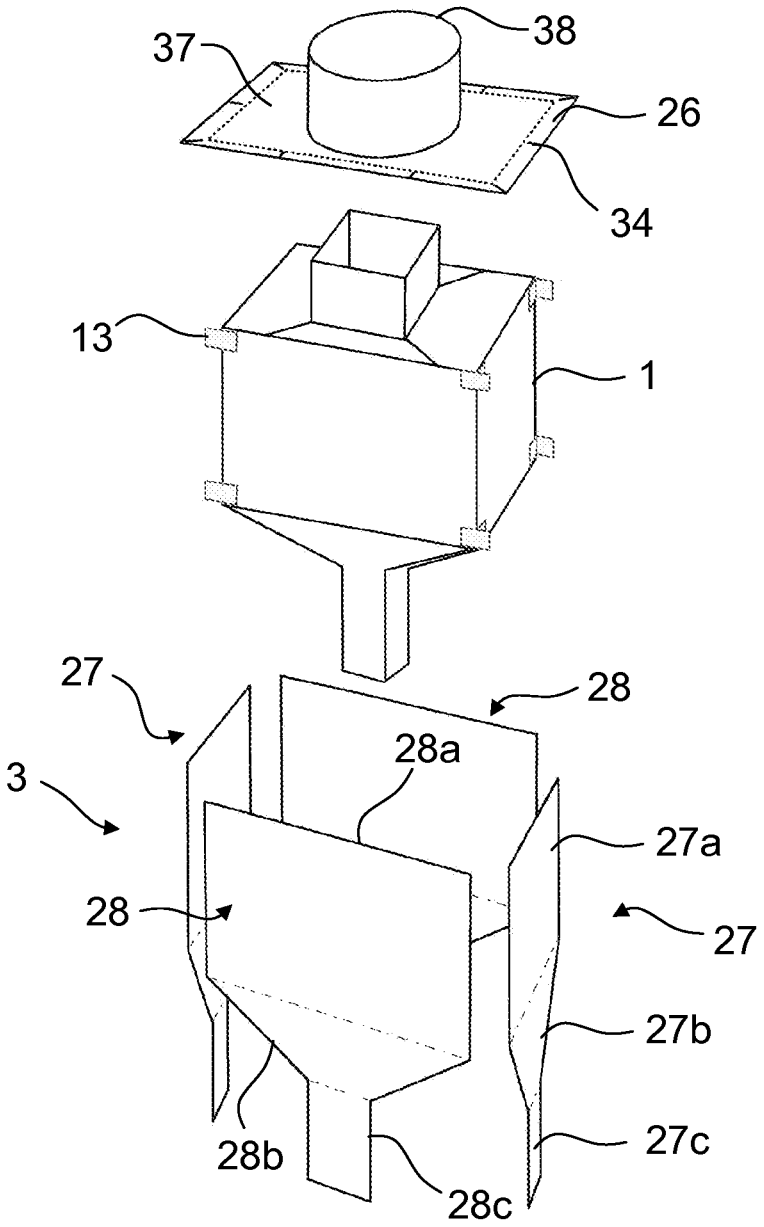
FIG. 8 shows part of step B) of assembling the inner protective envelope of rectangular cross-section with the outer envelope in order to form a large-capacity pliable container.

The method for producing a large-capacity pliable container 2 comprises a step B) of assembling the inner protective envelope of rectangular cross-section 1 with the outer envelope 3 so as to form the large-capacity pliable container 2, as illustrated in FIG. 8.

The outer envelope 3 is produced by assembling five panels, of which one upper panel 26, two small-sized lateral panels 27 and two large-sized lateral panels 28. Such panels are made of polymeric material, for example of polypropylene.

Each small-sized lateral panel 27 comprises a square or rectangular upper portion 27*a*. Each large-sized lateral panel 28 comprises a rectangular upper part 28*a*.

Each lateral panel 27, 28 comprises an intermediate part 27*b*, 28*b* adapted to form a lower truncated conical portion 30 for the outer envelope 3.

Each lateral panel 27, 28 comprises a lower portion 27*c*, 28*c* adapted to form a discharge spout 31 for the outer envelope 3.

During the assembling step B), the outer envelope 3 is obtained by sewing the panels 26, 27, 28 which are positioned around the inner protective envelope of rectangular cross-section 1 so that the latter can be inserted into the outer envelope 3.

In other words, the outer envelope 3 is sewn around the inner protective envelope having a rectangular cross-section 1.

The fixing lugs 13 are incorporated into the seams that enable the panels 26, 27, 28 of the outer envelope 3 to be assembled together, and extend through the outer envelope 3 at locations 20.

The inner protective envelope of rectangular cross-section 1 is thus made integral with the outer envelope 3 through the fixing lugs 13.

Figure 9:
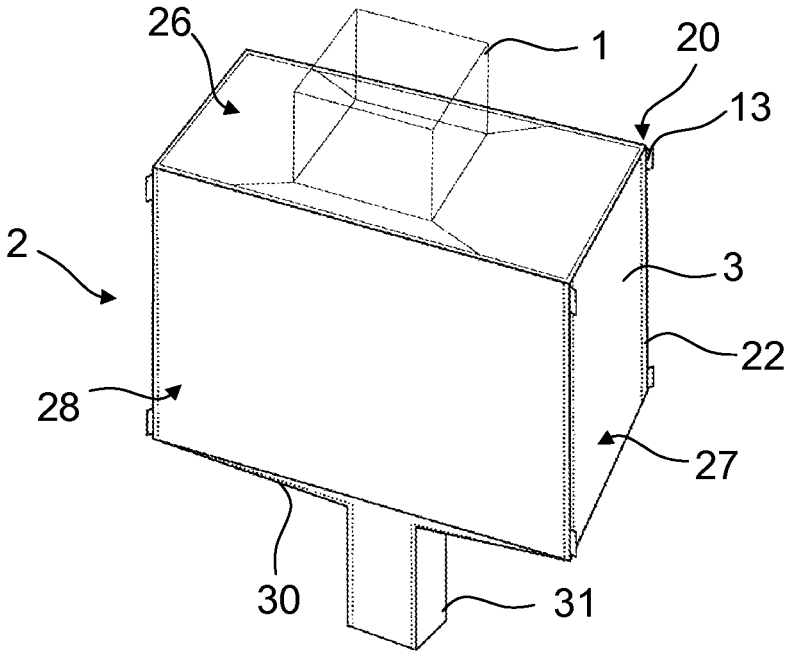
FIG. 9 shows a large-capacity pliable container of rectangular cross-section produced with the method according to the invention.

The inner protective envelope of rectangular cross-section 1 spreads out within the outer envelope 3 so that it fits the shape thereof. The eight fixing lugs 13 of the inner protective envelope of rectangular cross-section 1 are associated with eight locations 20, as illustrated in FIG. 9.

Preferably, the fixing lugs 13 of the inner protective envelope of rectangular cross-section 1 are positioned on the lateral edges 21 of the inner protective envelope of rectangular cross-section 1. The locations 20 of the outer envelope 3 are positioned on the lateral edges 22 of the outer envelope 3 so that they are facing the fixing lugs 13, and ensure that the total volume of the inner protective envelope 1 has spread out within the outer envelope 3.

Such fixing means do not affect the tightness of the inner protective envelope 1 and ensure perfect consistency of the shapes of both envelopes 1, 3. This is very important in the packaging of medicines as the emptying of the inner protective envelope 1 must be complete without the need to intervene inside for facilitating the dropping of the last remaining pieces contained therein.

The lateral panels 27, 28 are first assembled by sewing to form an outer envelope body. The upper panel 26 is subsequently sewn on the upper part of the outer envelope body.

The upper panel 26 comprises a flat portion 37 topped with a filling spout 38 of cylindrical shape having a circular or elongated cross-section. It may also be of parallelepipedic shape.

The filling spout 12*a* of the inner protective envelope 1 is adapted to project partially from said filling spout 38 of the outer envelope 3.

The upper panel 26 comprises fixing slots 34 distributed on its periphery.

Figure 10:
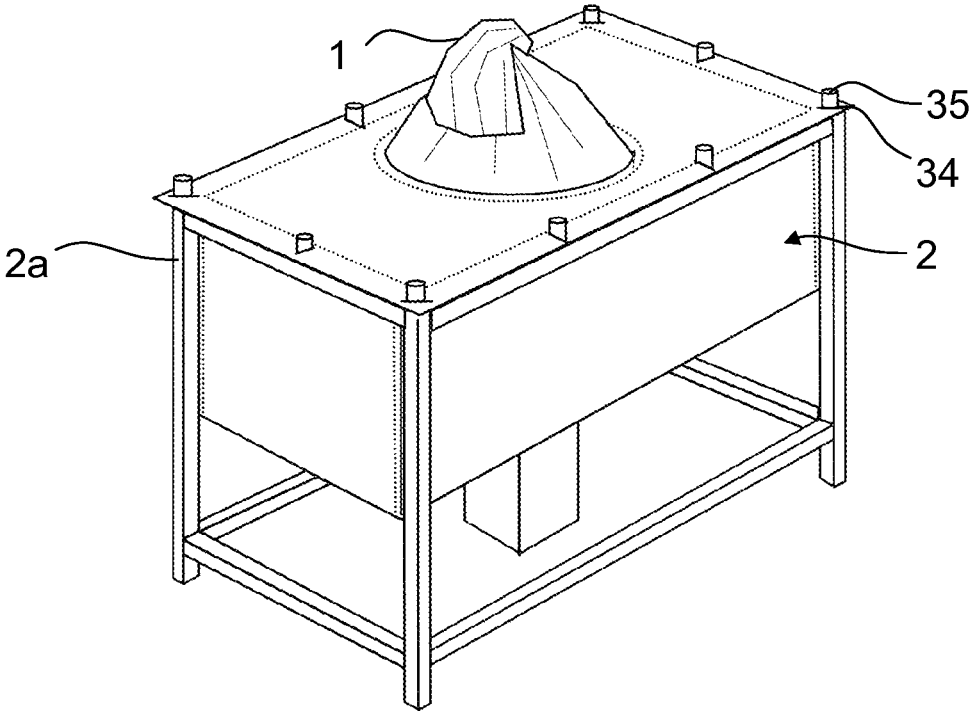
FIG. 10 shows the same pliable container mounted within a metal frame.

The large-capacity pliable container 2 is intended to be inserted into a metal frame 2*a* which is used as a support structure, as illustrated in FIG. 10, the size of the whole assembly being easily integrated into standard storage racks and adaptable to the various filling and discharge devices in the pharmaceutical industry.

The fixing slots 34 of the upper panel 26 of the outer envelope 3 are inserted into pins 35 projecting from the upper edge of the metal frame 2*a*.

The manufacturing method according to the invention thus allows producing large-capacity pliable containers 2 of parallelepipedic rectangular shape without polluting the inside of the inner protective envelope 1.

Large-capacity pliable containers 2 may have, for instance, a 68×108 mm rectangular cross-section and be accommodated in 79×119 mm metal frames.

The invention claimed is:

1. A method for producing a large-capacity pliable container (2), wherein said container comprises an inner protective envelope of plastic material to be inserted into an outer envelope (3), said method comprising the following steps:

A) manufacturing the inner protective envelope, by:

a) producing a tubular bellows-type sleeve using an extrusion-blow molding process including a process of forming folds on the tubular bellows-type sleeve, said tubular bellows-type sleeve having a folded shape after the step a), b) cutting a portion of the tubular bellows-type sleeve to produce a folded bellows-type sleeve (1*a*) having a rectangular shape, said folded bellows-type sleeve (1*a*) consisting of two opposite open ends (4*a*, 4*b*) and two lateral folding regions (5*a*, 5*b*) separated by a central longitudinal axis (6), each lateral folding region (5*a*, 5*b*) comprising three folding lines (7*a*, 7*b*, 7*c*):

one inner folding line (7*b*) which extends along and close to the central longitudinal axis (6), and two outer folding lines (7*a*, 7*c*), c) cutting lateral folding regions (5*a*, 5*b*) in the four corners (8) of the folded bellows-type sleeve in such a way as to obtain a folded bellows-type sleeve (1*a*) having two narrowed portions (9*a*, 9*b*) at its open ends (4*a* 4*b*), each of said narrowed portions being delimited by two lateral cut borders, each comprising four cutting edges (11) stacked together, d) soldering adjacent cutting edges (11) for each of said lateral cut borders in such a way as to produce, when the folded bellows-type sleeve (1*a*) is unfolded, a parallelepipedic inner protective envelope of square cross-section (1*b*), which comprises a spout (12*a*, 12*b*) having a square cross-section at its top (23*a*) and bottom (23*b*) ends, and e) sticking fixing lugs (13) to two opposite lateral fixing faces (14*a*, 14*b*) of the folded bellows-type sleeve (1*a*), each of said lateral fixing faces (14*a*, 14*b*) comprising at least four fixing lugs, characterized in that the method comprises the following steps:

f) applying a tractive force to the fixing lugs (13) in order to deform by stretching the parallelepipedic inner protective envelope of square cross-section (1*b*) and to obtain a parallelepipedic inner protective envelope of rectangular cross-section (1), said inner protective envelope of rectangular cross-section (1) comprising four lateral faces, of which said two lateral fixing faces (14*a*, 14*b*) and two opposite stretched lateral faces (15*a*, 15*b*) of rectangular shape, each comprising an upper edge (16*a*), a lower edge (16*b*) and two outer lateral pockets (17*a*, 17*b*) extending along said upper (16*a*) and lower (16*b*) edges, respectively, g) soldering the outer lateral pockets (17*a*, 17*b*) to isolate them from the rest of the inner protective envelope of rectangular cross-section, h) cutting the outer lateral pockets (17*a*, 17*b*) to remove them from the two stretched lateral faces (15*a*, 15*b*); and B) assembling the inner protective envelope of rectangular cross-section (1) with the outer envelope (3) in order to form said large-capacity pliable container 2.

2. Method for producing a parallelepipedic inner protective envelope of rectangular cross-section (1) as part of a method for producing a large-capacity pliable container according to claim 1, characterized in that, during step e) of sticking the fixing lugs (13), four fixing lugs (13) are stuck to each of the lateral fixing faces (14*a*, 14*b*) of the folded bellows-type sleeve (1*a*), said fixing lugs (13) being adjacent to the four corners (25) of the lateral fixing faces (14*a*, 14*b*).

3. Method for producing a parallelepipedic inner protective envelope of rectangular cross-section (1) according to claim 2, characterized in that the fixing lugs (13) are T-shaped adhesive fixing lugs.

4. Method for producing a parallelepipedic inner protective envelope of rectangular cross-section (1) according to claim 2, characterized in that the step c) of cutting the lateral folding regions comprises, for each lateral folding region (5*a*, 5*b*), two cutting operations in order to obtain two symmetrical cuts relative to the central longitudinal axis (6), each cutting operation being carried out along a first oblique cut (18) relative to the central longitudinal axis (6) and along a second cutting line (19) parallel to the central longitudinal axis (6).

5. Method for producing a parallelepipedic inner protective envelope of rectangular cross-section (1) according to claim 2, characterized in that the cutting steps b), c) and h) are carried out ultrasonically or by means of a hot blade.

6. Method for producing a parallelepipedic inner protective envelope of rectangular cross-section (1) according to claim 2, characterized in that the soldering steps d) and g) are carried out by heat sealing.

7. Method for producing a parallelepipedic inner protective envelope of rectangular cross-section (1) according to claim 2, characterized in that step g) of soldering the outer lateral pockets (17*a*, 17*b*) is performed outside the inner protective envelope (1).

8. Method for producing a parallelepipedic inner protective envelope of rectangular cross-section (1) according to claim 2, characterized in that, the outer envelope (3) being made of several panels of polymeric material, of which one upper panel (26), two small-sized lateral panels (27) and two large-sized lateral panels (28), during the assembling step B), the outer envelope (3) is produced by sewing said panels around the inner protective envelope of rectangular cross-section (1) in such a way as to insert the latter into the outer envelope (3), the fixing lugs of the inner protective envelope of rectangular cross-section (1) being incorporated into the seams formed between said panels.

9. Method for producing a parallelepipedic inner protective envelope of rectangular cross-section (1) according to claim 8, characterized in that the fixing lugs (13) are positioned on the lateral edges (21) of the inner protective envelope of rectangular cross-section (1), said fixing lugs (13) extending through the outer envelope (3) at the lateral edges thereof.

* * * * *